US010292457B2

(12) United States Patent
Adkison et al.

(10) Patent No.: US 10,292,457 B2
(45) Date of Patent: May 21, 2019

(54) WARMING RACK FOR ARTICLES OF FOOTWEAR

(71) Applicant: Acorn Engineering Company, City Of Industry, CA (US)

(72) Inventors: Christopher Adkison, Ontario, CA (US); Christopher Cornish, Kirkland, WA (US)

(73) Assignee: Acorn Engineering Company, City of Industry, CA (US)

( * ) Notice: Subject to any disclaimer, the term of this patent is extended or adjusted under 35 U.S.C. 154(b) by 0 days.

(21) Appl. No.: 15/824,267

(22) Filed: Nov. 28, 2017

(65) Prior Publication Data

US 2018/0146749 A1 May 31, 2018

Related U.S. Application Data

(60) Provisional application No. 62/427,379, filed on Nov. 29, 2016.

(51) Int. Cl.
*A43D 95/10* (2006.01)
*A47B 61/04* (2006.01)
(Continued)

(52) U.S. Cl.
CPC ..... *A43D 95/10* (2013.01); *A43B 3/26* (2013.01); *A43D 3/1408* (2013.01); *A43D 95/12* (2013.01); *A47B 61/04* (2013.01)

(58) Field of Classification Search
CPC ..... A43D 95/10; A43D 95/12; A47B 61/04; D06F 59/06; A47L 23/20; A47K 10/06; A61L 2/202; A43B 3/26
(Continued)

(56) References Cited

U.S. PATENT DOCUMENTS 446,312 A * 2/1891 Wikle ..... A43D 5/02 12/123
1,891,274 A * 12/1932 Winkley ..... A43D 11/14 12/41.5
(Continued)

FOREIGN PATENT DOCUMENTS

DE 19823166 A1 9/1999
DE 20013095 U1 11/2000
(Continued)

OTHER PUBLICATIONS

Derwent2010-Q19573, Nov. 2010, China, Hong, Y.*

*Primary Examiner* — Ko H Chan
(74) *Attorney, Agent, or Firm* — Eric J. Sosenko; Jonathan P. O'Brien; Honigman LLP

(57) ABSTRACT

A warming rack for holding footwear includes a base and an array of support posts supported by the base. The base defines a length extending between a first end and a second end and a width between a pair of opposing side edges. The array of support posts is configured to retain multiple articles of footwear above the base. Each support posts includes a first portion extending from a proximal end in a first direction substantially perpendicular to the base to a bend line, and a second portion extending at an angle relative to the first direction from the bend line to a terminal end. The second portion is configured to retain a corresponding article of footwear in a fixed position when the second portion is received by an interior void of the footwear.

19 Claims, 6 Drawing Sheets

(51) Int. Cl.
*A43D 95/12* (2006.01)
*A43B 3/26* (2006.01)
*A43D 3/14* (2006.01)

(58) Field of Classification Search
USPC ..... 211/34
See application file for complete search history.

(56) References Cited

U.S. PATENT DOCUMENTS 1,925,210 A 9/1933 Smith
2,098,735 A * 11/1937 Yentis ..... A43D 95/10 12/123
2,275,334 A * 3/1942 Young ..... A43D 95/12 12/59.7
2,488,533 A 11/1949 Mieth et al.
2,929,082 A * 3/1960 Schultz ..... A43D 95/12 12/59.7
3,078,526 A * 2/1963 Caruso ..... A61L 2/202 194/242
3,256,420 A * 6/1966 Werman ..... A43D 25/20 12/1 R
3,474,476 A * 10/1969 Forma ..... A43D 11/14 12/59.7
3,483,577 A * 12/1969 Schultz ..... A43D 8/52 12/1 R
3,589,522 A * 6/1971 Chiodo ..... A47L 23/20 211/34
3,608,738 A * 9/1971 Andersen ..... A47L 23/20 211/38
3,798,788 A * 3/1974 Kuntz ..... A47L 23/205 34/104
4,085,519 A * 4/1978 Masika ..... A47L 23/20 223/66
4,136,464 A * 1/1979 Hay ..... A47L 23/20 239/274
4,517,442 A * 5/1985 Price ..... A43D 25/20 12/41.5
4,598,193 A * 7/1986 Hanson ..... A43D 25/20 12/41.5
4,727,656 A 3/1988 Jannach et al.
D310,742 S * 9/1990 Johnson ..... D32/58
D383,276 S * 9/1997 Janney ..... D32/58
5,776,378 A * 7/1998 Knight ..... A61L 9/122 261/30
D412,231 S * 7/1999 Williams ..... D32/58
6,005,227 A * 12/1999 Pappas ..... A47K 10/06 219/386
6,345,148 B1 2/2002 Chang
6,839,982 B1 * 1/2005 Hoover ..... A61M 11/00 34/104
2013/0185951 A1 7/2013 Williams

FOREIGN PATENT DOCUMENTS

DE 202004004259 U1 6/2004
EP 0243342 A1 10/1987
FR 659782 A 7/1929

* cited by examiner

WARMING RACK FOR ARTICLES OF FOOTWEAR

CROSS REFERENCE TO RELATED APPLICATION

This application is a non-provisional patent application claiming benefit under 35 U.S.C. 119(e) of U.S. provisional patent application No. 62/427,379 filed on Nov. 29, 2016, the entire contents of which are hereby incorporated by reference.

TECHNICAL FIELD

This disclosure relates to warming articles of footwear, and more particularly to a warming rack for holding multiple articles of footwear within a heating chamber to warm the articles of footwear.

BACKGROUND

Athletes generally desire their shoes to conform to their feet in a comfortable manner when participating in sports. Shoes, such as sporting cleats used for football, soccer, or baseball, are typically formed from leather and/or synthetic materials that are initially stiff and require a break-in period to soften the materials and provide a comfortable fit around the wearer's feet. An athlete generally experiences discomfort, and sometimes pain, that reduces the athlete's performance while breaking in a new pair of shoes. Additionally, some shoes never fully conform in a manner that provides a snug fit around the wearer's feet, leaving athletes with only the option to wear a smaller than recommended shoe size to achieve the snug fit. While some athletes may achieve an increase in performance while wearing smaller than recommended shoe sizes, these athletes must accept some level of discomfort and/or pain which can eventually lead to foot injuries or injuries to other body parts.

In an attempt to reduce the break-in period and/or achieve a customized fit within a new set of shoes, some athletes soak their shoes in warm water to soften the leather and/or synthetic materials that form the shoes. Upon soaking, the athletes will wear the wet shoes so that the shoes conform around the contours of the feet as the shoes dry. This requires the wearer to participate in athletic movements with wet shoes, thereby resulting in slippage and shifting of the feet relative to the shoes, thereby increasing the risk of injury. In addition to decreased stability and support, this slipping and shifting of the feet can lead to blisters and/or abrasions upon the wearer's feet, as well as increased wear upon insoles of the shoes. Moreover, as the leather and/or synthetic materials dry after being soaked in warm water, the shoes may become even more stiff and require an even longer break-in period to achieve a comfortable fit.

SUMMARY

One aspect of the disclosure provides a warming rack for holding footwear that includes a base and an array of support posts supported by the base. The base has a substantially planar upper surface and defines a length between a first end and a second end and a width between a pair of opposing side edges. The array of support posts is configured to retain multiple articles of footwear above the base. Each support posts has a first portion extending in a first direction substantially perpendicular to the base from a proximal end to a bend line, and a second portion extending at an angle relative to the first direction from the bend line to a terminal end. The second portion is configured to retain a corresponding article of footwear in a fixed position when the second portion is received by an interior void of the footwear Implementations of the disclosure may include one or more of the following optional features. In some implementations, the terminal ends of the support posts are disposed further form the upper surface of the base than the bend lines of the support posts. At least one of the support posts may include an engagement feature disposed on the terminal end and configured to engage interior surfaces of the corresponding article of footwear when the second portion is received by the interior void of the footwear.

In some examples, the array of support posts includes a first series of support posts having their respective terminal ends collinearly spaced apart from one another along the length of the base and disposed closer to one of the opposing side edges than their respective proximal ends, and a second series of support posts having their respective terminal ends collinearly spaced apart from one another along the length of the base and disposed closer to the other one of the opposing side edges than their respective proximal ends. A first line may pass through each of the terminal ends of the first series of support posts and a second line may pass through each of the terminal ends of the second series of support posts. The first and second lines may each extend substantially parallel to the opposing side edges along the length of the base. In some configurations, each adjacent pair of the first series of support posts and the second series of support posts includes one of the support posts having the respective terminal end disposed closer to one of the first end and the second end of the base than the respective proximal end and the other one of the support posts having the respective terminal end disposed closer to the other one of the first end and the second end of the base than the respective proximal end. Additionally, the array of support posts may include a third series of support posts having their respective terminal ends collinearly spaced apart from one another along the length of the base and disposed a substantially equal distance away from each of the opposing side edges as their respective proximal ends. Here, each adjacent pair of the third series of support posts may include one of the support posts having the respective terminal end disposed closer to one of the first end and the second end of the base than the respective proximal end and the other one of the support posts having the respective terminal end disposed closer to the other one of the first end and the second end of the base than the respective proximal end.

In some implementations, the base defines a lateral axis that bisects the length of the base into a first zone and a second zone, the first zone of the base configured to support a first group of the support posts and the second zone of the base configured to support a second group of the support posts. In these implementations, the second portions in each of the first group of the support posts may extend toward their respective terminal ends in different directions away from one another, and the second portions of the second group of the support posts may extend toward their respective terminal ends in different directions away from one another. In some examples, one of the second portions in the first group of the support posts extends toward the respective terminal end in a second direction and one of the second portions of the second group of the support posts extends toward the respective terminal end in a third direction. The second direction and the third direction may extend away from one another, may be converging, or the second direction may be substantially parallel to the third direction.

In some implementations, the warming rack includes a first brace member supported by the base in the first zone above the upper surface and a second brace member supported by the base in the second zone above the upper surface. The first brace member defines a first group of apertures each defining a longitudinal axis extending substantially perpendicular to the upper surface of the base, the first group of apertures receiving corresponding ones of the first portions of the first group of the support posts. The second brace member defines a second group of apertures each defining a longitudinal axis extending substantially perpendicular to the upper surface of the base, the second group of apertures receiving corresponding ones of the first portions of the second group of the support posts.

Another aspect of the disclosure provides a heating system for warming footwear that includes a housing defining a chamber configured to hold a quantity of water, a heating element disposed within the chamber and operative to heat the quantity of water, and a warming rack disposed within the chamber and configured to hold a plurality of articles of footwear above the quantity of water. The warming rack includes a base supported by the housing within the chamber and having a substantially planar upper surface and defining a length between a first end and a second end and a width between a pair of opposing side edges, and an array of support posts supported by the base and configured to retain multiple articles of footwear above the upper surface of the base. Each support member has a first portion extending in a first direction substantially perpendicular to the upper surface of the base from a proximal end at the upper surface to a bend line, and a second portion extending at an angle relative to the first direction from the bend line to a terminal end. The second portion is configured to retain a corresponding article of footwear in a fixed position above the upper surface of the base when the second portion is received by an interior void of the footwear.

This aspect may include one or more of the following optional features. In some examples, the base further includes a plurality of holes formed through the upper surface and a bottom surface disposed on an opposite side of the base than the upper surface. In these examples, the holes are configured to allow steam produced when the water is heated to pass through the base and interact with the footwear. The base may define a lateral axis that bisects the length of the base into a first zone and a second zone, the first zone of the base configured to support a first group of the support posts centered about a longitudinal axis of the base and a first zone lateral axis offset from the lateral axis of the base, and the second zone of the base configured to support a second group of the support posts centered about the longitudinal axis of the base and a second zone lateral axis offset from the lateral axis of the base. Here, the second portions of the first group of the support posts may extend away from one another in different directions angularly displaced about the first zone lateral axis and the second portions of the second group of the support posts may extend away from one another in different directions angularly displaced about the second zone lateral axis. In some examples, the first zone lateral axis and the second zone lateral axis are each offset from the lateral axis of the base on opposite sides by an equal distance.

The details of one or more implementations of the disclosure are set forth in the accompanying drawings and the description below. Other aspects, features, and advantages will be apparent from the description and drawings, and from the claims.

DESCRIPTION OF DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 2:
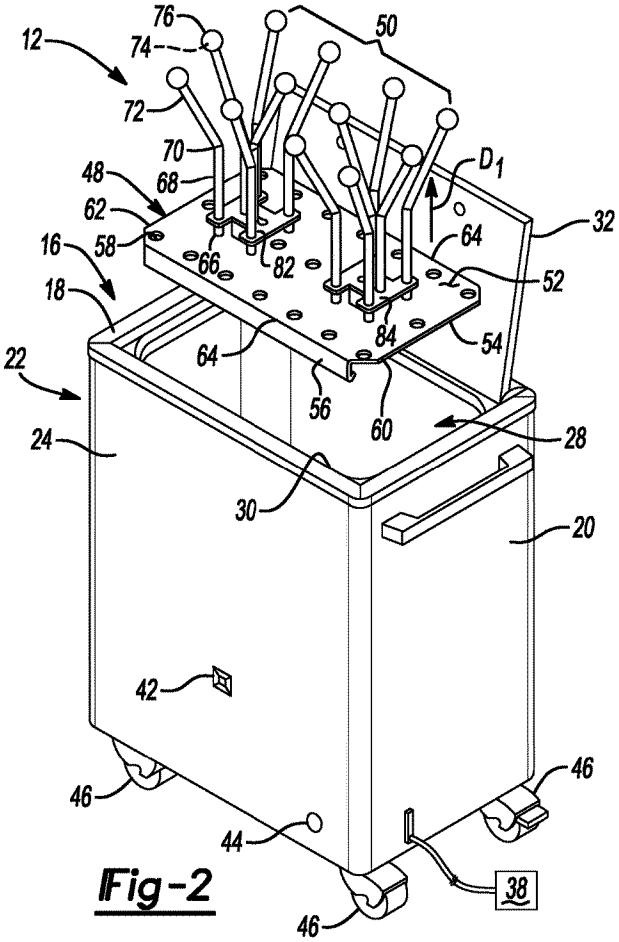
FIG. 2 is an exploded view of the heating system of FIG. 1.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 1:
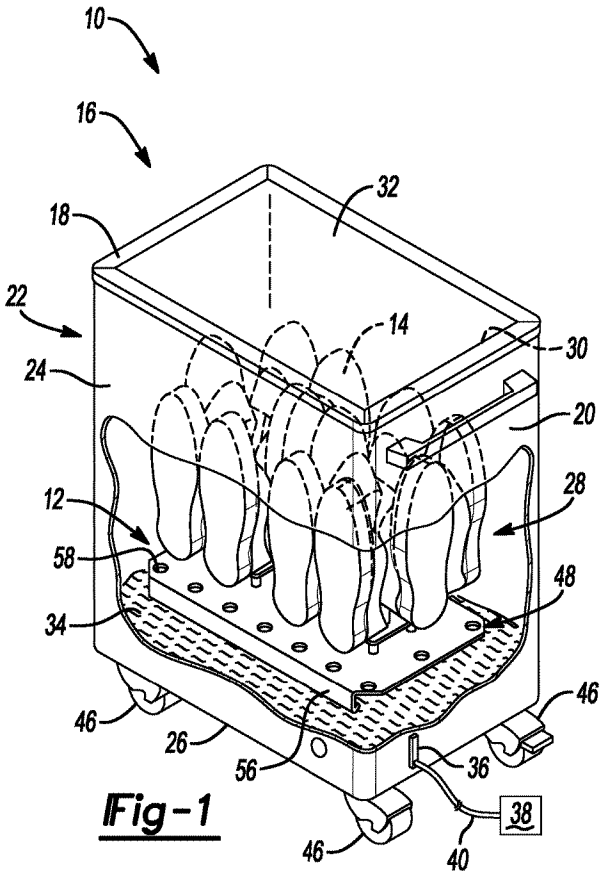
FIG. 1 is a perspective cutaway view of a footwear heating system including a footwear warming rack received within a heating unit in accordance with principles of the present disclosure.

Referring to FIGS. 1 and 2, a heating system 10 is provided and includes a warming rack 12 configured to retain multiple articles of footwear 14 in a fixed position within a heating unit 16. FIG. 1 provides a cutaway perspective view of the heating system 10 with the articles of footwear 14 retained by the warming rack 12 while received within the heating unit 16. The heating unit 16 includes a housing 18 having a front panel 20, a rear panel 22, and opposed side panels 24 all extending perpendicularly from a perimeter of a closed bottom panel 26 to define a chamber 28 accessible through an opening 30 at a top end of the housing 18; the opening 30 being disposed on an opposite end of the housing 18 from the closed bottom panel 26. The housing 18 may define a length extending between the front and rear panels 20, 22, a width extending between the opposed side panels 24, and a height extending between the closed bottom panel 26 and the opening 30 at the top end of the housing 18. A lid 32 pivotally attaches to the housing 18 at the top end and is movable between an open position (FIG. 2) configured to provide access to the chamber 28 through the opening 30, and a closed position (FIG. 1) configured to close the opening 30 and prevent access to the chamber 28. The warming rack 12 may be placed into the chamber 28 through the opening 30 when the lid 32 is in the open position. FIG. 1 shows the warming rack 12 and footwear 14 enclosed within the chamber 28 when the lid 32 is in the closed position. In some implementations, the lid 32 engages with top edges of the front panel 20, the rear panel 22, and the opposite side panels 24 to provide a fluid tight seal within the chamber 28. In other implementations, the lid 32 engages with a lip formed by interior surfaces of the front panel 20, the rear panel 22, and the opposite side panels 24 offset from the top edges to provide the fluid tight seal with a flush top surface. In some configurations, a sealing gasket is provided to sealing engage the lid 32 to the top edges or the offset lip associated with the panels when the lid 32 is moved to the closed position.

The heating unit 16 is configured to heat a quantity of water 34 disposed within the chamber 28 for warming the footwear 14 retained by the warming rack 12 when the warming rack 12 is received by the chamber 28. For example, the heating unit 16 may include at least one heating element 36 disposed within the chamber 28 at a location sufficient to interact with the water 34 for heating the water 34 when the heating element 36 is operable in an ON state. The heating element 36 may be operatively connected to a power source 38 via wiring 40 to provide power to the heating element 36. The power source 38 may include an external power source such as an electrical outlet or an energy storage device (e.g., battery) removably connected to the housing 18 of the heating unit 16. In some configurations, the heating unit 16 includes a thermostat 42 operable to control the heating element 36 between an OFF state and the ON state. For instance, the thermostat 42 may be disposed upon an exterior surface of one of the panels 20, 22, 24.

The heating unit 16 may also include a valve 44 movable between a closed position to retain the quantity of water 34 in the chamber 28 and an open position to drain some or all of the quantity of water 34 from the chamber 28. For instance, the quantity of water 34 can be drained from the chamber 28 so that the heating unit 16 may be cleaned, and thereafter, the valve 44 may be moved from the open position to the closed position so that a fresh quantity of water 34 can re-fill the chamber 28 to a desirable water level. In some scenarios, the warming rack 12 may be removed from the heating unit 16 by opening the lid 32 so that the warming rack 12 can be cleaned. Additionally, a user may retrieve the footwear 14 hanging from the warming rack 12 while supported within the chamber 28 and position new footwear 14 upon the warming rack 12 by simply opening the lid 32 and accessing the warming rack 12 through the opening 28 without requiring the user to remove the warming rack 12 from the chamber 28. In some configurations, the heating unit 16 is portable and includes one or more wheels 46 disposed on the bottom panel 26 of the housing 18 to allow the heating unit 16 to be rolled upon a ground surface for easy transport between different locations.

In some implementations, the heating unit 16 operates the heating element 36 in the ON state during a steaming cycle to adjustably heat the quantity of water 34 to a desired temperature that is suitable for producing steam within the chamber 28 that interacts with the footwear 14 hanging from the warming rack 12. In some examples, the thermostat 42 is adjustable to allow the user to set a desired temperature for heating the water 32 and producing the steam. The desired temperature may be set to temperatures ranging from about 65° Fahrenheit (F) to about 175° F. In some examples, the thermostat 42 is pre-set to a desired temperature equal to about 165° F. While leather and/or synthetic materials forming the footwear 14 may be initially rigid and stiff when the footwear 14 is new, or otherwise not yet broken in, the combination of warmth, steam, and humidity produced within the enclosed chamber 28 during the steaming cycle alters the flexibility of the footwear 14 to provide a more conformed and comfortable fit for a wearer's feet, thereby enabling the wearer of the footwear 14 to attain a customized fit. In some examples, the steaming cycle occurs over a predetermined time period that may be adjustable between times ranging from about 2 minutes to about 30 minutes depending upon preferences of wearers associated with the footwear 14. Accordingly, a timer may be associated with the thermostat 42 to set the time period of the steaming cycle. In some scenarios, the steaming cycle is operable to steam and contour the fit of new unworn articles of footwear to provide a custom fit to the wearer and drastically reduce the time to initially break-in the new footwear. In other scenarios, the steaming cycle is operable to steam pre-worn articles of footwear before each use to maintain a "soft" and "relaxed" state of the leather and/or synthetic materials forming the footwear 14. Accordingly, when wearers place the footwear 14 on their feet subsequent to steaming, the footwear 14 conforms to the wearers' feet for a more optimal and customized fit.

In some implementations, the quantity of water 34 fills the chamber 28 to a water level sufficient for submerging the heating element 36 while avoiding direct contact with the footwear 14 hanging from the warming rack 12. The warming rack 12 includes a base 48 supported by the housing 18 within the chamber 28 and an array of support posts 50 each supported by the base 48 and configured to retain corresponding ones of the articles of footwear 14 in a fixed position relative to the base 48 and above the quantity of water 32. The base 48 is substantially planar and opposes the inner surface of the bottom panel 26 while the support posts 50 extend from the base 48 away from the bottom panel 26 of the housing 18 to retain the footwear 14 above the base 48 such that no portion of the hanging footwear 14 is submerged in the quantity of water 34. In some examples, the quantity of water 34 includes a water level at or just below the base 48. The base 48 may also include a pair of flanges 56 each extending away from opposite sides of the base 48 and toward the bottom panel 26 of the housing 18. Each flange 56 may engage a corresponding engagement feature of the housing 12 to support the base 48 in a fixed position within the chamber 28. In some configurations, the base 48 includes a plurality of holes 58 formed therethrough and configured to permit steam and/or water 34 to pass through the base 48. In some examples, the quantity of water 34 within the chamber 28 is filled to a level below the base 48 such that steam produced during the steaming cycle is permitted to pass through the base 48 via the holes 58 and interact with the footwear 14, thereby softening and relaxing the leather and/or synthetic materials that form the footwear 14. In other examples, the quantity of water 34 is filled to a level that resides above the base 48 but without touching the footwear 14 hanging from the warming rack 12. For instance, smaller size footwear 14 may hang from the warming rack 12 without touching the quantity of water 34 even when the water 34 is associated with a water level residing above the base 48. In some scenarios, smaller size footwear 14 subsequent to being steamed may be replaced with larger size footwear 14 that may hang into contact with the quantity of water 34. In these scenarios, the water level is adjustable by opening the valve 44 to release a portion of the quantity of water 34 from the chamber 28 to achieve a lower water level that does not contact footwear 14 associated with larger sizes.

FIG. 2 provides an exploded view of the heating system 10 with the warming rack 12 removed from the chamber 28 and not retaining any articles of footwear 14. The base 48 defines a substantially planar upper surface 52 and a lower surface 54 disposed on an opposite side of the base 48 than the upper surface 52 and facing toward the bottom panel 26 when the warming rack 12 is received within the chamber 28 of the housing 18. The base 48 may define a length LB (FIG. 7) extending along a longitudinal axis L (FIG. 7) between a first end 60 and a second end 62, and a width $W_B$ (FIG. 7) extending along a lateral axis $LAT_B$ (FIG. 7) between a pair of opposing side edges 64. Each flange 58 may extend from the bottom surface 54 of the base 48 in a direction substantially perpendicular to the longitudinal axis L and the lateral axis $LAT_B$ of the base 48. The base 48 may be formed from stainless steel or other rigid materials that are resistant to tarnishing and rust.

Each support post 50 is an angled post supported by the base 48 at a proximal end 66. The support posts 50 include a first portion 68 extending in a first direction $D_1$ substantially perpendicular to the longitudinal axis L of the base 48 from the proximal end 68 to a bend line 70. A second portion 72 of the support posts 50 extends at an angle relative to the first direction $D_1$ from the bend line 70 to a terminal end 74. The terminal ends 74 are each a leading end that is to be inserted into an interior void of a corresponding article of footwear 14 such that second portions 72 are received by the interior voids to support and retain the footwear 14 on the support posts 50 in a fixed position above the upper surface 52 of the base 48. More specifically, the footwear 14, while retained by the support posts 50 in the fixed position, defines a longitudinal axis extending substantially parallel to the first direction $D_1$ between a heel end of the footwear, which opposes the upper surface 52 of the base 48, and a toe end of the footwear 14, which opposes the opening 28 or the lid 32 when in the lid 32 is in the closed position. In some configurations, one or more of the support posts 50 include an engagement feature 76 disposed on the respective terminal end 76. In these configurations, the engagement feature 76 is configured to engage interior surfaces of the footwear 14 when the respective second portion 72 is received by the interior void to firmly hold the corresponding article of footwear 14. In some examples, the engagement feature 76 includes a knob or ball-shaped member that keeps the upper portion of the footwear 14 substantially taut and prevent the leather and/or synthetic materials forming the footwear 14 from conforming around circumferential surfaces of the respective second portions 72

The second portions 72 may extend at an angle $\alpha$ (FIG. 3) relative to the first direction $D_1$ that is less than 90°. Accordingly, the second portions 72 extend at angles relative to the first direction $D_1$ associated with the respective first portions 68 such that the respective terminal ends 74 are disposed a further distance from the upper surface 52 of the base 48 than the respective bend lines 70 of the support posts 50. In some examples, the second portions 72 extend at an angle of substantially 20° relative to the first direction $D_1$ at which the respective first portions 68 extend.

Figure 3:
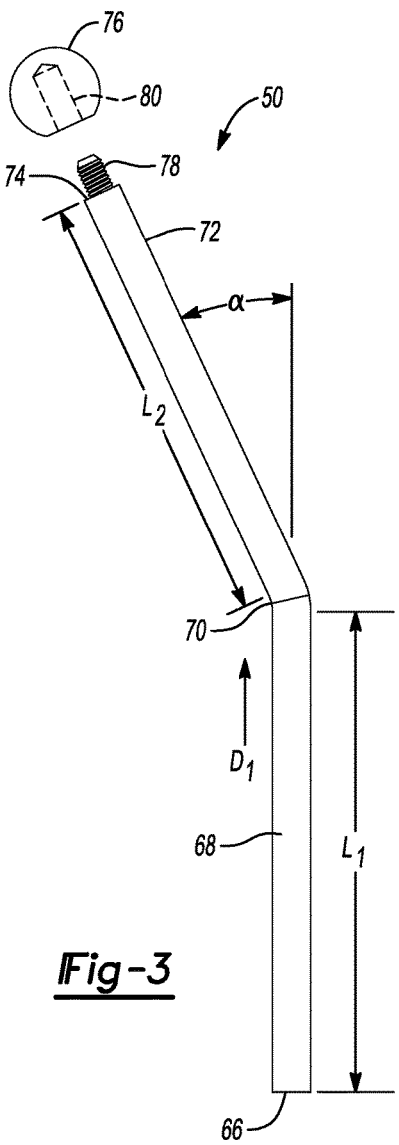
FIG. 3 is an exploded view of a support post and engagement member.

FIG. 3 shows an exploded view of one of the angled support posts 50 and the corresponding engagement feature 76 of FIG. 2. The first portion 68 of the support post 50 defines a first length $L_1$ extending in the first direction $D_1$ between the proximal end 68 and the bend line 70, while the second portion 72 defines a second length $L_2$ extending at the angle $\alpha$ (e.g., substantially 20°) relative to first direction $D_1$ between the bend line 70 and the terminal end 74. In some examples, the first length $L_1$ is greater than the second length $L_2$. In some implementations, a threaded insert 78 is connected to the second portion 72 at the terminal end 74 and extends away from the terminal end 74. The threaded insert 78 is configured to engage with corresponding threads 80 of the engagement feature 76 such that the engagement feature 76 can be removably attached to the second portion 72 at the terminal end 74. The threaded insert 78 may be welded to the terminal end 74 of the second portion 72 or the terminal end 74 may itself be formed with threads. In other examples, the engagement feature 76 is fixedly secured to the terminal end 74 of the second portion 72 through welding or other securing techniques. The support posts 50 may be formed from stainless steel or other rigid materials that are resistant to tarnishing and rust.

Figure 4:
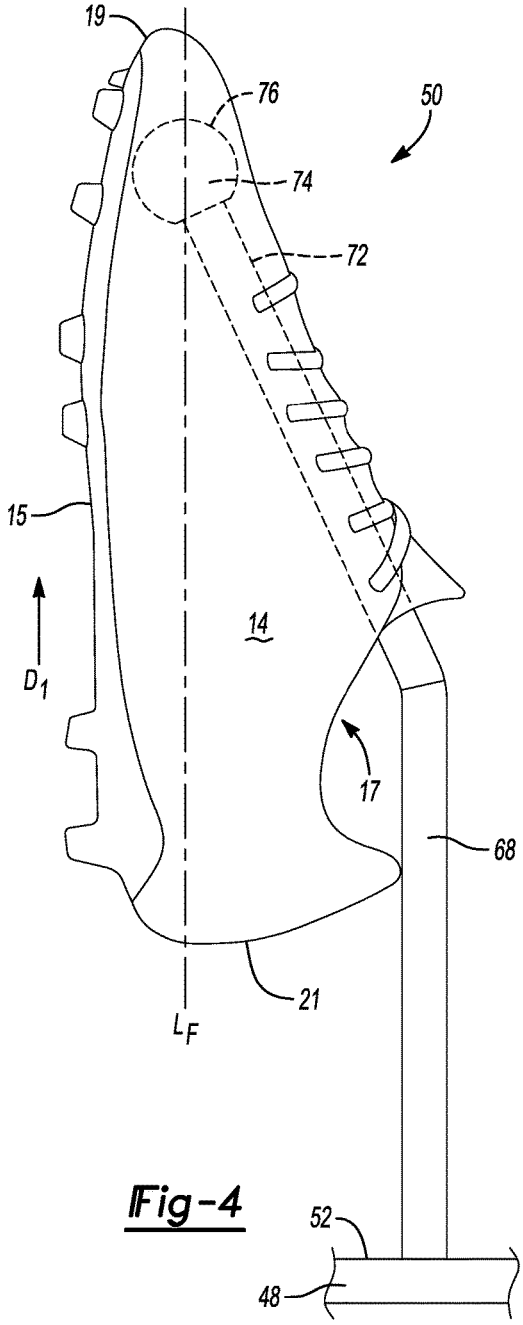
FIG. 4 is a side elevational view of a support post retaining an article of footwear.

FIG. 4 is a side elevational view of one of the angled support posts 50 retaining a corresponding article of footwear 14. The engagement feature 76 inserts into an interior void 17 of the footwear 14 such that the second portion 72 is received by the interior void 17 to support and retain the footwear 14 on the support post 50 in the fixed position above the upper surface 52 of the base 48. As seen in FIG. 4, when inserted into the footwear 14, the engagement feature 74 is disposed proximate to a toe end 19 of the footwear 14 so as to allow the footwear 14 to hang therefrom with a heel end 21 adjacent to a length of the first portion 68 of the support post 50. Thus, the footwear 14 is retained by the support post 50 such that a longitudinal axis $L_F$ of the footwear 14 extends substantially vertically, or parallel to the first direction $D_1$, between the heel end 21 and the toe end 21. Moreover, an outsole 15 of each article of footwear 14 retained by corresponding ones of the support posts 50 faces away from the corresponding support post 50.

Referring back to FIG. 2, in some implementations, the warming rack 12 includes first and second support braces 82, 84 each supported by the base 48 above the upper surface 52 and configured to retain each support post 50 in a fixed position relative to the base 48. For example, the support braces 82, 84 may prevent the support posts 50 from detaching from the base 48 while retaining the corresponding articles of footwear thereon. The support braces 82, 84 may be formed from stainless steel or other rigid materials that are resistant to tarnishing and rust. The outsoles 15 of the articles of footwear 14 face radially away from the support braces 82, 84 while retained by corresponding ones of the support posts 50.

Figure 5:
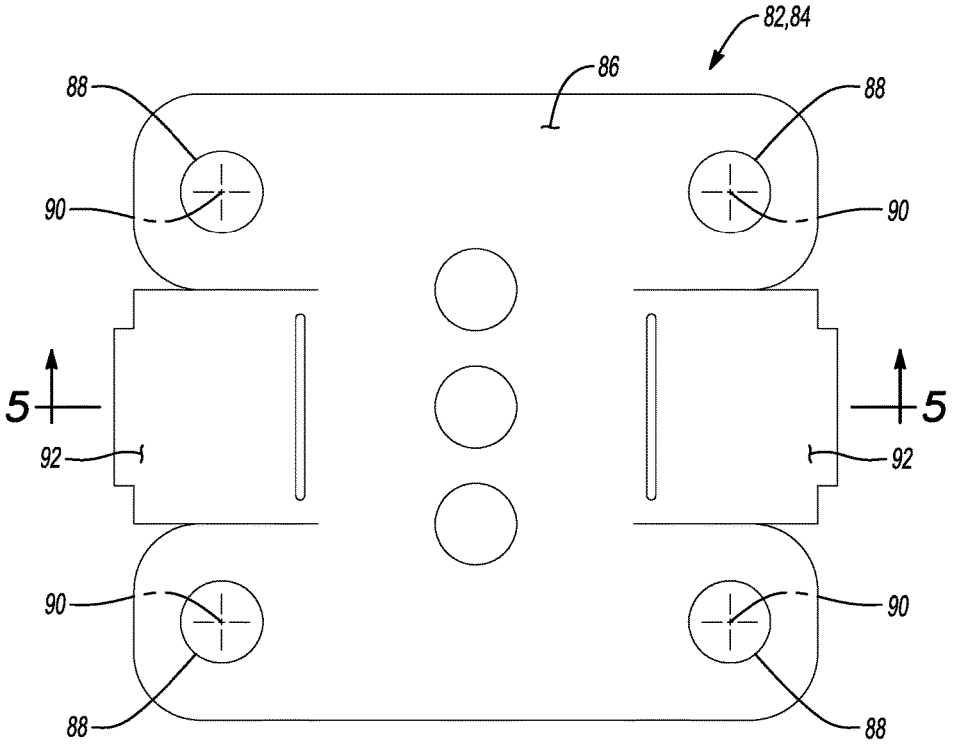
FIG. 5 is a top view of a support brace of the warming rack of FIG. 1.

FIG. 5 shows a top view of one of the support braces 82, 84. As seen therein, the support braces 82, 84 define a substantially planar plate portion 86 that opposes the upper surface 52 of the base 48 and in which is defined a group of apertures 88, each defining a longitudinal axis 90 extending substantially perpendicular to the upper surface 52 of the base 48. Each aperture 88 is configured to receive a corresponding one of the first portions 68 of the support posts 50 along the first length $L_1$.

Figure 6:
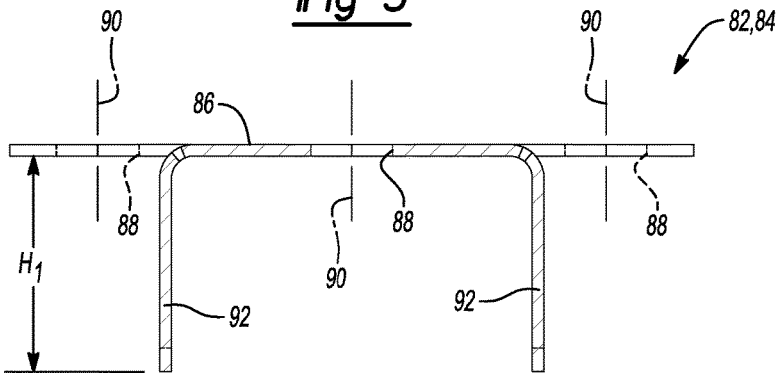
FIG. 6 is a side view of a support brace of the warming rack of FIG. 1.

The plate portion 86 may have one or more support legs 92 that support the plate portion 86 at a first height $H_1$ above the upper surface 52 of the base 48 (as shown in FIG. 2). The plate portion 86 and the support legs 92 may be integrally formed from a flat planar sheet of material, whereby each support leg 92 is subsequently bent at a right angle (e.g., substantially 90°) relative to the plate portion 86 providing the braces 82, 84 with an "H-shape" in top plan view. FIG. 6 shows a side view of the support brace 82, 84 of FIGS. 2 and 5 with the two support legs 92 extending away from the plate portion 86 in a direction substantially perpendicular to the plate portion 86 (and the upper surface 52 of the base 48) to define a first height $H_1$ between the plate portion 86 and the upper surface 52 of the base 48 (as generally seen in FIG. 2).

Figure 7:
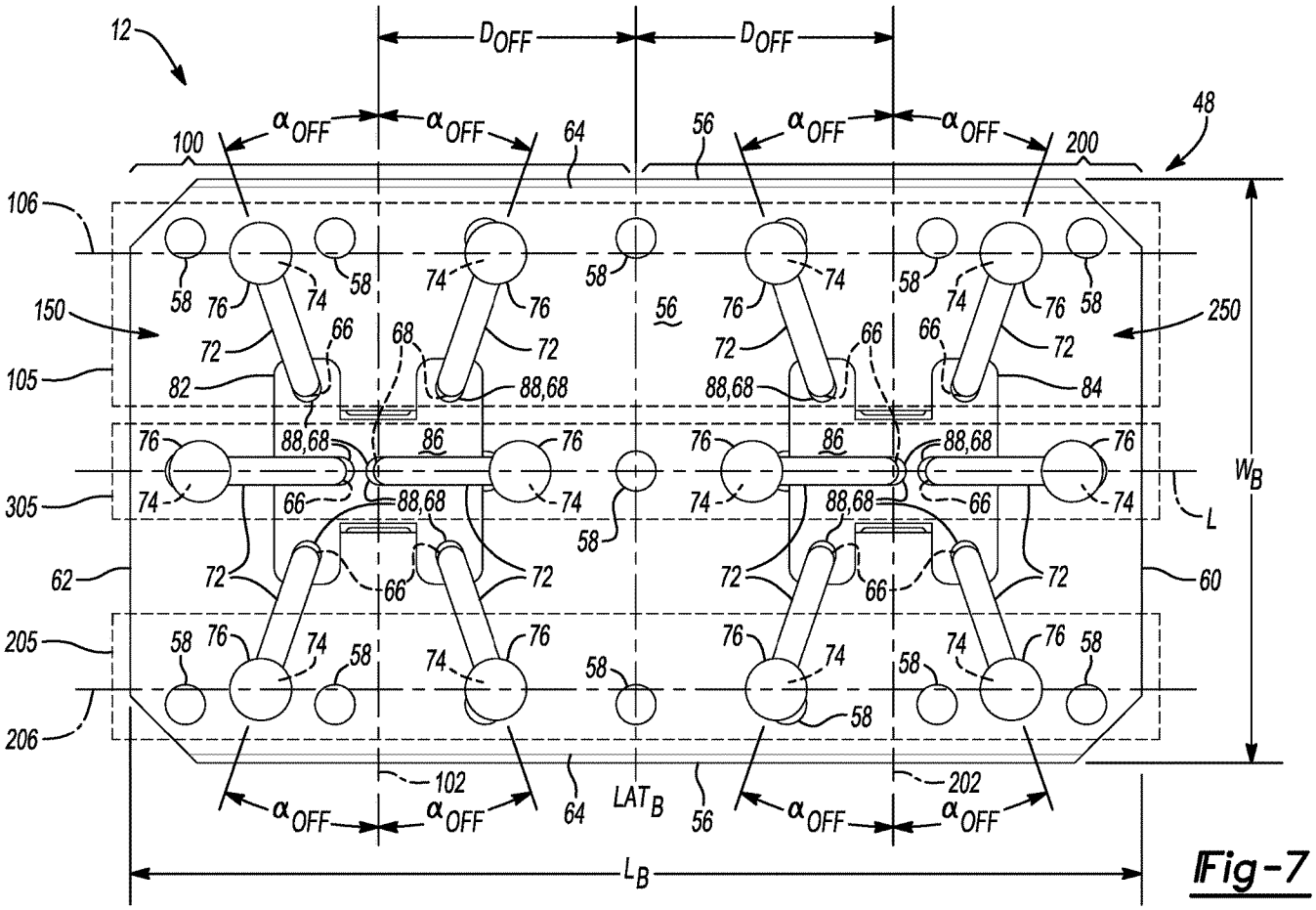
FIG. 7 is a top view of the warming rack of FIG. 1.

Referring to FIG. 7, a top view of the warming rack 12 of FIGS. 1 and 2 shows the lateral axis $LAT_B$ of the base 48 extending along the width $W_B$ of the base 48 to bisect the length LB of the base 48 into a left or first zone 100 and a right or second zone 200. The first zone 100 is configured to support a first group 150 of the support posts 50 and the second zone 200 is configured to support a second group 250 of the support posts 50. The first group 150 and the second group 250 may be associated with an equal or different number of support posts 50. While the example shows each group 150, 250 including six support posts 50, other examples can include each group 150, 250 including less than six support posts 50 or more than six support posts 50. The first zone 100 defines a lateral axis 102 extending substantially parallel to the lateral axis $LAT_B$ of the base 48 between the opposing side edges 64. Similarly, the second zone 200 defines a lateral axis 202, on an opposite side of the lateral axis $LAT_B$ that extends substantially parallel to the lateral axis $LAT_B$ of the base 48 between the opposing side edges 64. In some implementations, the lateral axis 102 of the first zone 100 and the lateral axis 202 of the second zone 200 are each offset from the lateral axis $LAT_B$ of the base 48 by an equal offset distance $D_{OFF}$. One of the support braces 82, 84 is supported by the base 48 and substantially centered about an intersection point between the first zone lateral axis 102 and the longitudinal axis L. The other of the support braces 82, 84 is supported by the base 48 and substantially centered about an intersection point between the second zone lateral axis 202 and the longitudinal axis L. Thus, the apertures 88 formed through the plate portion 86 of the first support brace 82 are associated with a first group of corresponding apertures configured to receive the first portions 68 of the first group 150 of the support posts 50. Similarly, the apertures 88 formed through the plate portion 86 of the second support brace 82 are associated with a second group of corresponding apertures configured to receive the first portions 68 of the second group 250 of the support posts 50.

In some implementations, the support posts 50 in each of the first and second groups 150, 250 cooperate to provide a first, second and third series 105, 205, 305 of support posts 50. The first series 105, the second series 205, and the third series 305 of support posts 50 may each include an equal number of support posts 50. For instance, half of the support posts 50 of each series 105, 205, 305 may be associated with the first group 150 of support posts 50 while the other half of the support posts 50 may be associated with the second group 250 of support posts 50. In the example provided, each series 105, 205, 305 includes four support posts 50. In other examples, each series 105, 205, 305 may include less than four support posts 50 or more than four support posts 50.

The first series 105 of support posts 50 include their respective terminal ends 74 (and engagement members 76) collinearly spaced apart from one another along the length LB of the base 48 and disposed closer to the top side edge 64 of the base 48 relative to the view of FIG. 7 than their respective proximal ends 66. A first straight line 106 passes through each of the terminal ends 74 of the first series 105 of support posts and extends substantially parallel to the top side edge 64 along the length LB of the base 48. The first line 106 is offset between the top side edge 64 and the longitudinal axis L of the base 48. Accordingly, neither the terminal ends 74 nor the engagement members 76 extend beyond a plane perpendicularly extending from the top side edge 64 of the base 48. As such, articles of footwear 14 hanging from corresponding ones of the first series 105 of support posts 50 do not engage or make contact with the interior surface of the housing 18 that opposes the first series 105 of support posts 50 when the warming rack 12 is received by the chamber 28. Generally, the outsole 15 of each article of footwear 14 retained by the first series of support posts 50 opposes the interior surface of the corresponding one of the side panels 24 of the housing 18. Moreover, in some implementations, each adjacent pair of the first series 105 of support posts 50 includes one of the support posts 50 having its respective terminal end 74 (and engagement member 76) disposed closer to one of the first end 60 and the second end 62 of the base 48 than its respective proximal end 66, and the other one of the support posts 50 having its respective terminal end 74 (and engagement member 76) disposed closer to the other one of the first end 60 and the second end 62 of the base 48 than its respective proximal end 66.

Similarly, the second series 205 of support posts 50 include their respective terminal ends 74 (and engagement members 76) collinearly spaced apart from one another along the length LB of the base 48 and disposed closer to the bottom side edge 64 of the base 48 relative to the view of FIG. 7 than their respective proximal ends 66. A second straight line 206 passes through each of the terminal ends 74 of the second series 205 of support posts 50 and extends substantially parallel to the bottom side edge 64 along the length LB of the base 48. The second line 206 is offset between the bottom side edge 64 and the longitudinal axis L of the base 48. Accordingly, neither the terminal ends 74 nor the engagement members 76 extend beyond a plane perpendicularly extending from the bottom side edge 64 of the base 48, such that articles of footwear 14 hanging from corresponding ones of the second series 205 of support posts 50 do not engage or contact an interior surface of the housing 18 that opposes the second series 205 of support posts 50 when the warming rack 12 is received by the chamber 28. Generally, the outsole 15 of each article of footwear 14 retained by the second series 250 of support posts 50 opposes the interior surface of a corresponding one of the side panels 24 of the housing 18. Moreover, in some implementations, each adjacent pair of the second series 105 of support posts 50 includes one of the support posts 50 having its respective terminal end 74 (and engagement member 76) disposed closer to one of the first end 60 and the second end 62 of the base 48 than its respective proximal end 66, and the other one of the support posts 50 having its respective terminal end 74 (and engagement member 76) disposed closer to the other one of the first end 60 and the second end 62 of the base 48 than its respective proximal end 66.

The third series 305 of support posts 50 include their respective terminal ends 74 (and engagement members 76) collinearly spaced apart from one another along the length LB of the base 48 and disposed a substantially equal distance away from each of the opposing side edges 64 as their respective proximal ends 66. In other words, the longitudinal axis L of the base 48 passes through the proximal ends 66 and the terminal ends 74 of the third series 305 of support posts 50. As with the first and second series 105, 205 of support posts 50, each adjacent pair of the third series 305 of support posts 50 includes one of the support posts 50 having its respective terminal end 74 (and engagement member 76) disposed closer to one of the first end 60 and the second end 62 of the base than its respective proximal end 66, and the other one of the support posts 50 having its respective terminal end 74 (and engagement member 76) disposed closer to the other one of the first end 60 and the second end 62 of the base 48 than its respective proximal end 66.

In the example provided, the second portions 72 of the support posts 50 in the first group 150 each extend toward their respective terminal ends 74 (and engagement features 76) in different directions away from one another. To put another away, the second portions 72 are angularly displaced about the first zone lateral axis 102. For example, the pair of support posts 50 in the first group 150 that are associated with the first series 105 include respective second portions 72 extending away from one another toward respective ones of the first end 60 and the second end 62 of the base 48 and including a displacement angle $\alpha_{OFF}$ relative to the first zone lateral axis 102. Similarly, the pair of support posts 50 in the first group 150 associated with the second series 205 include respective second portions 72 each extending away from one another toward respective ones of the first end 60 and the second end 62 of the base 48 and including the displacement angle $\alpha_{OFF}$ relative to the first zone lateral axis 102. In some examples, the displacement angle $\alpha_{OFF}$ is substantially equal to 20° such that the second portions 72 of each pair of the first series 105 and the second series 205 of support posts 50 in the first group 150 are displaced from one another angle substantially equal to 40°. The support posts 50 in the first group 150 associated with the third series 205 include respective second portions 72 each extending away from one another in opposite directions substantially perpendicular to the first zone lateral axis 102 toward respective ones of the first end 60 and the second end 62 of the base 48.

As with the second portions 72 of the support posts 50 in the first group 150, the second portions 72 of the support posts 50 in the second group 250 also each extend toward their respective terminal ends 74 (and engagement features 76) in different directions away from one another. To put another away, the second portions 72 are angularly displaced about the second zone lateral axis 202. In some examples, the angular displacement associated with the second group 250 about the second zone lateral axis 202 and the angular displacement associated with the first group 150 about the first zone lateral axis 102 are symmetrical with respect to the lateral axis $LAT_B$ of the base 48. Thus, the pair of support posts 50 in the second group 250 that are associated with the first series 105 include respective second portions 72 each extending away from one another toward respective ones of the first end 60 and the second end 62 of the base 48 and including the displacement angle $\alpha_{OFF}$ relative to the second zone lateral axis 202, while the pair of support posts 50 in the second group 250 associated with the second series 205 include respective second portions 72 each extending away from one another toward respective ones of the first end 60 and the second end 62 of the base 48 and including the displacement angle $\alpha_{OFF}$ relative to the first zone lateral axis 102. As with the support posts 50 in the first group 150 associated with the third series 305, the support posts 50 in the second group 250 associated with the third series 305 include respective second portions 72 each extending away from one another in opposite directions substantially perpendicular to the second zone lateral axis 202 toward respective ones of the first end 60 and the second end 62 of the base 48.

These angular displacements associated with the second portions 72 of the support posts 50 in each of the first group 150 and second group 250 is operative to maximize the number of articles of footwear 14 that can be retained by the warming rack 12 within the chamber 28 of the heating unit 12 while simultaneously providing sufficient space between each article of footwear 14. The sufficient spacing between the articles of footwear 14 allows steamed footwear 14 to be easily retrieved from the warming rack 12 and footwear 14 selected for steaming to be easily hung upon an available support post 50 without interfering with other articles of footwear 14.

In some implementations, one of the second portions 72 in the first group 150 of support posts 50 extends toward the respective terminal end 74 in a second direction and one of the second portions 72 of the second group 250 of support posts 40 extends toward the respective terminal end 74 in a third direction. In some examples, the second direction and the third direction extend away from one another. In other examples, the second direction and the third direction are converging. In even other examples, the second direction extends substantially parallel to the third direction.

Figure 8:
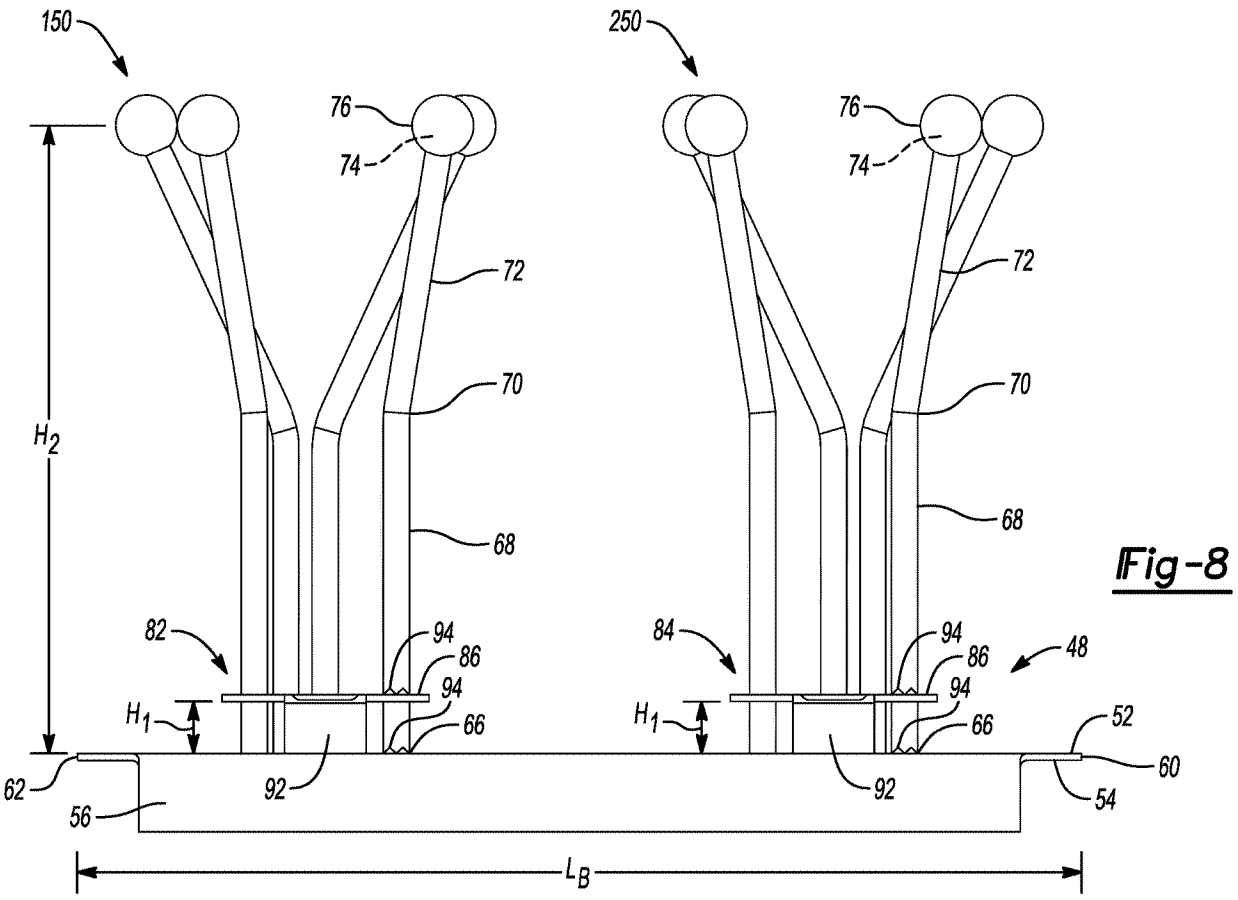
FIG. 8 is a front view of the warming rack of FIG. 1.

FIG. 8 shows a side view of the warming rack 12 of FIGS. 1 and 2 including the base 48 supporting the first and second groups 150, 250 of support members 50. The first brace member 82 disposed in the first zone 100 and the second brace member 84 disposed in the second zone 200 each include their respective support legs 92 supporting the respective plate portion 86 above the upper surface 52 of the base 48 at the first height $H_1$ and define the apertures that receive a portion of the first length $L_1$ of the first portion 68 of each corresponding support post 50. The first portion 68 of each support post 50 may be fixedly attached to the base 48 via a seam weld 94 between the upper surface 52 of the base 48 and the proximal end 66 of the support post 50. Additionally or alternatively, the first portion 68 of each support post 50 may be fixedly attached to the plate portion 86 of the respective one of the first brace member 82 and the second brace member 84 via a seam weld 94 between the respective plate portions 86 and outer circumferential surfaces of the first portions 68 of the support posts 50.

Figure 9:
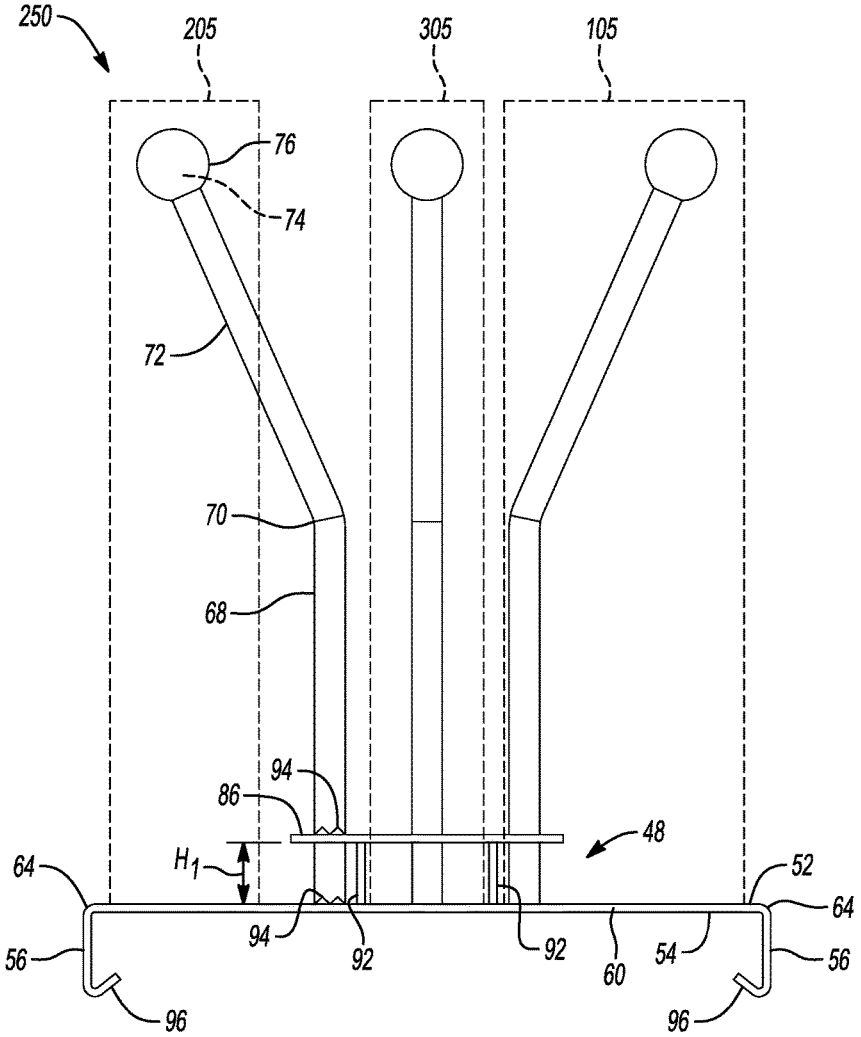
FIG. 9 is a side view of the warming rack of FIG. 1.

FIG. 9 shows an end view of the warming rack 12 of FIGS. 1 and 2 including the base 48 supporting the second group 250 of support posts 50. Relative to the view of FIG. 9, the first group 150 of support posts 50 is obstructed from view by the second group 250 of support posts 50. As described above with reference to FIG. 8, the first portion 68 of each support post 50 may be fixedly attached to the base 48 and/or the second brace member 84 via a seam weld 94. The pair of flanges 56 each extend from corresponding ones of the opposing side edges 64 of the base 48 in a direction away from the bottom surface 54 of the base 48. Each flange 56 may include a bent distal end to define a corresponding lip 96 that extends toward the bottom surface 54 of the base 48 and converges toward the other lip 96. The lips 96 may facilitate engagement with one or more engagement features of the housing 18 to support the base 48 within the chamber 28 at a fixed position relative to the housing 18.

A number of implementations have been described. Nevertheless, it will be understood that various modifications may be made without departing from the spirit and scope of the disclosure. Accordingly, other implementations are within the scope of the following claims.

What is claimed is:

1. A heating system for warming footwear, the heating system comprising:

a housing defining a chamber configured to hold a quantity of water;

a heating element disposed within the chamber and operative to heat the quantity of water;

a warming rack disposed within the chamber and configured to hold a plurality of articles of footwear, the warming rack including a base and an array of support posts configured to retain a corresponding article of footwear in a fixed position when the support posts are received by an interior void of the footwear;

the base defining a length between a first end and a second end and a width between a pair of opposing side edges, the base including a lateral axis that bisects the length of the base into a first zone and a second zone, the first zone of the base configured to support a first group of the support posts and the second zone of the base configured to support a second group of the support posts; and the array of support posts being supported by the base and configured to retain multiple articles of footwear above the base, each support post having a first portion extending from a proximal end in a first direction to a bend line, and each support post also having a second portion extending from the bend line at an angle relative to the first direction to a terminal end, the second portion configured to retain a corresponding article of footwear in a fixed position when the second portion is received by an interior void of the footwear.

2. The heating system of claim 1, wherein the terminal ends of the support posts are disposed further from the base than the bend lines of the support posts.

3. The heating system of claim 1, wherein at least one of the support posts includes an engagement feature disposed on the terminal end, the engagement feature configured to engage interior surfaces of the corresponding article of footwear when the second portion is received by the interior void of the footwear.

4. The heating system of claim 1, wherein the array of support posts includes a first series of support posts having their respective terminal ends collinearly spaced apart from one another along the length of the base and disposed closer to one of the opposing side edges than their respective proximal ends, and a second series of support posts having their respective terminal ends collinearly spaced apart from one another along the length of the base and disposed closer to the other one of the opposing side edges than their respective proximal ends.

5. The heating system of claim 4, wherein a first line passes through each of the terminal ends of the first series of support posts and a second line passes through each of the terminal ends of the second series of support posts, the first line and the second line each extending substantially parallel to the opposing side edges along the length of the base.

6. The heating system of claim 4, wherein the array of support posts includes a third series of support posts having their respective terminal ends collinearly spaced apart from one another along the length of the base and disposed a substantially equal distance away from each of the opposing side edges as their respective proximal ends.

7. The heating system of claim 6, wherein each adjacent pair of the third series of support posts includes one of the support posts having the respective terminal end disposed closer to one of the first end and the second end of the base than the respective proximal end and the other one of the support posts having the respective terminal end disposed closer to the other one of the first end and the second end of the base than the respective proximal end.

8. A warming rack for holding footwear, the footwear rack comprising:

a base defining a length between a first end and a second end and a width between a pair of opposing side edges; and an array of support posts supported by the base and configured to retain multiple articles of footwear above the base, each support post having a first portion extending from a proximal end in a first direction to a bend line, and each support post also having a second portion extending from the bend line at an angle relative to the first direction to a terminal end, the second portion configured to retain a corresponding article of footwear in a fixed position when the second portion is received by an interior void of the footwear;

the array of support posts includes a first series of support posts having their respective terminal ends collinearly spaced apart from one another along the length of the base and disposed closer to one of the opposing side edges than their respective proximal ends, and a second series of support posts having their respective terminal ends collinearly spaced apart from one another along the length of the base and disposed closer to the other one of the opposing side edges than their respective proximal ends; and wherein each adjacent pair of the first series of support posts and the second series of support posts includes one of the support posts having the respective terminal end disposed closer to one of the first end and the second end of the base than the respective proximal end and the other one of the support posts having the respective terminal end disposed closer to the other one of the first end and the second end of the base than the respective proximal end.

9. A warming rack for holding footwear, the footwear rack comprising:

a base defining a length between a first end and a second end and a width between a pair of opposing side edges;

an array of support posts supported by the base and configured to retain multiple articles of footwear above the base, each support post having a first portion extending from a proximal end in a first direction to a bend line, and each support post also having a second portion extending from the bend line at an angle relative to the first direction to a terminal end, the second portion configured to retain a corresponding article of footwear in a fixed position when the second portion is received by an interior void of the footwear;

the base defines a lateral axis that bisects the length of the base into a first zone and a second zone, the first zone of the base configured to support a first group of the support posts and the second zone of the base configured to support a second group of the support posts; and the second portions in each of the first group of the support posts extend toward their respective terminal ends in different directions away from one another, and the second portions of the second group of the support posts extend toward their respective terminal ends in different directions away from one another.

10. The warming rack of claim 1, wherein one of the second portions in the first group of the support posts extends toward the respective terminal end in a second direction and one of the second portions of the second group of the support posts extends toward the respective terminal end in a third direction.

11. The warming rack of claim 10, wherein the second direction and the third direction extend away from one another.

12. The warming rack of claim 10, wherein the second direction and the third direction are converging.

13. The warming rack of claim 10, wherein the second direction is substantially parallel to the third direction.

14. A warming rack for holding footwear, the footwear rack comprising:

a base defining a length between a first end and a second end and a width between a pair of opposing side edges;

an array of support posts supported by the base and configured to retain multiple articles of footwear above the base, each support post having a first portion extending from a proximal end in a first direction to a bend line, and each support post also having a second portion extending from the bend line at an angle relative to the first direction to a terminal end, the second portion configured to retain a corresponding article of footwear in a fixed position when the second portion is received by an interior void of the footwear;

the base defines a lateral axis that bisects the length of the base into a first zone and a second zone, the first zone of the base configured to support a first group of the support posts and the second zone of the base configured to support a second group of the support posts; and a first brace member supported by the base in the first zone above the upper surface, the first brace member defining a first group of apertures each defining a longitudinal axis extending substantially perpendicular to the upper surface of the base, the first group of apertures receiving corresponding ones of the first portions of the first group of the support posts; and a second brace member supported by the base in the second zone above the upper surface, the second brace member defining a second group of apertures each defining a longitudinal axis extending substantially perpendicular to the upper surface of the base, the second group of apertures receiving corresponding ones of the first portions of the second group of the support posts.

15. A heating system for warming footwear, the heating system comprising:

a housing defining a chamber configured to hold a quantity of water;

a heating element disposed within the chamber and operative to heat the quantity of water; and a warming rack disposed within the chamber and configured to hold a plurality of articles of footwear above an upper surface of the quantity of water, the warming rack comprising:

a base supported by the housing within the chamber and defining a length between a first end and a second end and a width between a pair of opposing side edges; and an array of support posts supported by the base and configured to retain multiple articles of footwear above the upper surface of the quantity of water, each support post having a first portion extending in a first direction substantially perpendicular to the upper surface from a proximal end to a bend line, and a second portion extending at an angle relative to the first direction from the bend line to a terminal end, the second portion configured to retain a corresponding article of footwear in a fixed position above the upper surface of the quantity of water when the second portion is received by an interior void of the footwear.

16. The heating system of claim 15, wherein the base includes a substantially planar upper surface having a plurality of holes defined there through, the plurality of holes configured to allow steam produced when the water is heated to pass through the base and interact with the footwear.

17. The heating system of claim 15, wherein the base defines a lateral axis that bisects the length of the base into a first zone and a second zone, the first zone of the base configured to support a first group of the support posts centered about a longitudinal axis of the base and a first zone lateral axis that is offset from the lateral axis of the base, and the second zone of the base configured to support a second group of the support posts centered about the longitudinal axis of the base and a second zone lateral axis that is offset from the lateral axis of the base.

18. The warming rack of claim 17, wherein the second portions of the first group of the support posts extend away from one another in different directions angularly displaced about the first zone lateral axis and the second portions of the second group of the support posts extend away from one another in different directions angularly displaced about the second zone lateral axis.

19. The warming rack of claim 17, wherein the first zone lateral axis and the second zone lateral axis are each offset from the lateral axis of the base on opposite sides by an equal distance.

* * * * *